US005755369A

United States Patent [19]

Holmes

[11] Patent Number: 5,755,369

[45] Date of Patent: May 26, 1998

[54] RAFFLE TICKET DISPENSER

[76] Inventor: Ronald J. Holmes, 505 Clinton St., Fayetteville, N.Y. 13066

[21] Appl. No.: 507,213

[22] Filed: Jul. 26, 1995

[51] Int. Cl.[6] ..... B26F 3/02

[52] U.S. Cl. ..... 225/52; 225/53; 225/90; 225/106; 206/214; 206/225; 206/409; 206/39.8

[58] Field of Search ..... 225/52, 53, 106, 225/39, 90, 34; 206/39, 39.8, 224, 214, 225, 397, 409

[56] References Cited

U.S. PATENT DOCUMENTS

| | | | |
|---|---|---|---|
| 1,704,044 | 3/1929 | Ingram | 225/106 |
| 2,352,445 | 6/1944 | Pinckney | 225/34 |
| 3,040,943 | 6/1962 | Bump | 225/52 |
| 4,047,652 | 9/1977 | Ehrlund | 225/54 |
| 4,071,201 | 1/1978 | Austin, Jr. | 242/55.2 |
| 4,204,618 | 5/1980 | Reed et al. | 225/106 |
| 4,239,164 | 12/1980 | Barnsbee et al. | 225/52 |
| 4,244,502 | 1/1981 | Reed | 225/13 |
| 4,280,643 | 7/1981 | Cordova et al. | 206/225 |
| 4,364,501 | 12/1982 | Curtiss, Jr. | 225/90 |
| 4,384,647 | 5/1983 | Schweizer | 206/214 |
| 4,807,744 | 2/1989 | Chiou | 206/214 |
| 4,881,675 | 11/1989 | Varley, III | 225/43 |
| 4,934,527 | 6/1990 | Ho | 206/214 |
| 5,109,978 | 5/1992 | Cawley | 206/225 |
| 5,228,612 | 7/1993 | Kuo et al. | 225/90 |
| 5,294,034 | 3/1994 | Svensson | 225/106 |
| 5,487,466 | 1/1996 | Robson | 206/214 |

*Primary Examiner*—Eugenia Jones
*Assistant Examiner*—Charles Goodman
*Attorney, Agent, or Firm*—Patent & Trademark Services; Joseph H. McGlynn

[57] ABSTRACT

A raffle ticket dispenser which incorporates a holder for a continuous strip of tickets which readily dispenses a single ticket or multiple tickets. The free end of the continuous strip of tickets is fed through an opening in the holder which has a ticket locator that maintains the first ticket in the strip readily available, and provides an edge to facilitate the removal of a single ticket or multiple tickets. In addition storage compartments are attached to the ticket holder to store items associated with the sale of the tickets. This makes a convenient, portable device which is easily moved from place to place and, also, keeps all necessary items together.

10 Claims, 1 Drawing Sheet

RAFFLE TICKET DISPENSER

BACKGROUND OF THE INVENTION

This invention relates in general to ticket dispensers and in particular to a ticket dispenser in which the free end of the roll of tickets is to be removed from the roll of tickets at a predetermined location, and in which the dispenser has storage compartments for storing items used in conjunction with the dispensing of tickets.

DESCRIPTION OF THE PRIOR ART

In the prior art ticket dispensers for removing a free end of a continuous strip of tickets having perforations spaced between the individual tickets have been known, however, the prior art ticket dispensers have been relatively costly to produce. The type of organizations that utilize this form of dispenser, i.e. small organizations, are financially unable to purchase an expensive device. Also, the prior art devices have not included any type of storage compartments for items associated with the sale of tickets, such as change and extra tickets.

SUMMARY OF THE INVENTION

The present invention is made from materials which are inexpensive and easily obtainable, and will meet the needs of small organizations. Also, it provides a raffle ticket dispenser which incorporates a holder for a continuous strip of tickets which readily dispenses a single ticket or multiple tickets. The free end of the continuous strip of tickets is fed through an opening in the holder which has a ticket locator that maintains the first ticket in the strip readily available, and provides an edge to facilitate the removal of a single ticket or multiple tickets. In addition storage compartments are attached to the ticket holder to store items associated with the sale of the tickets. This makes a convenient, portable device which is easily moved from place to place and, also, keeps all necessary items together.

It is an object of the present invention to provide an inexpensive holder for a continuous strip of tickets.

It is an object of the present invention to provide an inexpensive holder for a continuous strip of tickets which easily dispenses a single ticket or multiple tickets.

It is an object of the present invention to provide an inexpensive holder for a continuous strip of tickets which has a ticket locator that maintains the first ticket in the strip readily available, and a tear edge to facilitate the removal of a single ticket or multiple tickets.

It is an object of the present invention to provide an inexpensive holder for a continuous strip of tickets which has storage compartments attached to the ticket holder to store items associated with the sale of the tickets.

These and other objects and advantages of the present invention will be fully apparent from the following description, when taken in connection with the annexed drawings.

DESCRIPTION OF THE PREFERRED EMBODIMENT

Figure 1:
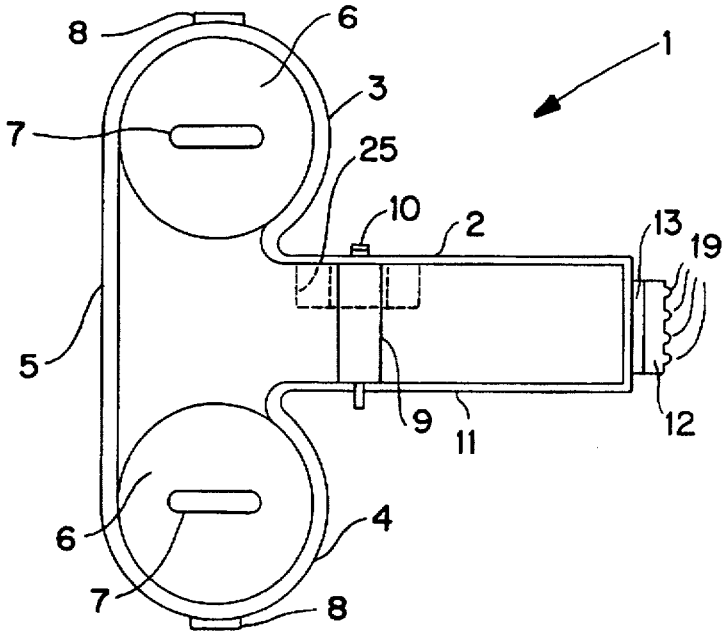
FIG. 1 is a top view of the ticket dispenser of the present invention with the handle and strap removed for clarity.

Referring to the drawings, FIG. 1 shows a top view of the ticket holder 1, in which the holder comprises a pair of side portions 2 and 11, which are connected at one end by a front portion. At the other end 5, the side portions are joined by a pair of semi-circular portions 3 and 4 which hold containers 14, shown in FIG. 2. The holder is preferably made of 3/32 of an inch plexiglass, however other materials may be used without departing from the scope of the invention. Also, even though the portions 3 and 4 are shown as semi-circular portions, other shapes could be used. For example, if the containers are rectangular the portions 3 and 4 would also be rectangular. Each of the semi-circular portions 3 and 4 has a snap 8 for a purpose which will be explained below.

Figure 3:
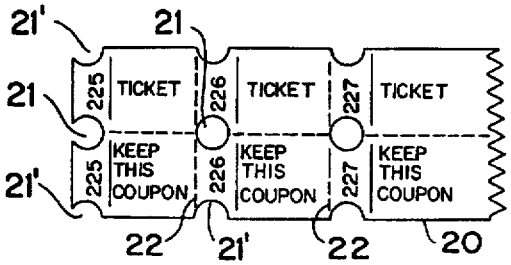
FIG. 3 is a view of the type of tickets that can be used with the ticket dispenser of the present invention.

Mounted in between the front and back of the holder is a shaft 9 which will hold the roll of raffle tickets. The shaft is preferably 1 inch in diameter and slightly wider than the outside width of the front of the body, and has a reduced portion 10 at each end which will act as an axle. The shaft is preferably made from polyurethane, however other materials and dimensions may be used without departing from the scope of the invention. The shaft 9 is designed to be used with a double roll of tickets, as shown in FIG. 3, however in the event that a roll of tickets which are a single width of tickets is used a spacer 25 (shown in dotted lines in FIG. 1 can be used). The spacer 25 is essentially a plastic spool that slips over the shaft 9 before the shaft is placed into the holder. The spacer 25 will be as wide as the width of a single ticket.

Figure 2:
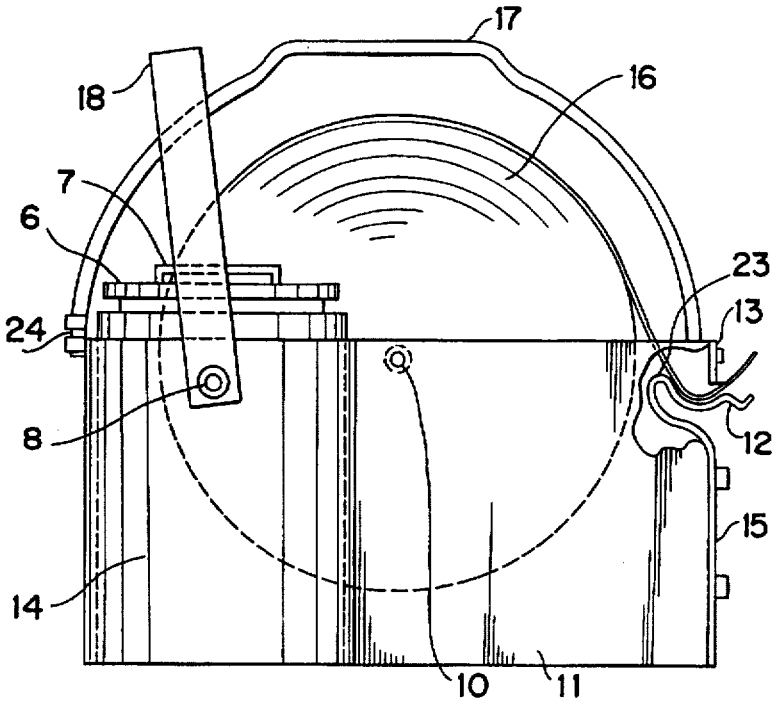
FIG. 2 is a side view of the ticket dispenser of the present invention with a cut away portion showing the ticket locator and tear off edge.

Mounted at the front of the holder is a locator made of two pieces 12 and 13, as shown more clearly in FIG. 2. The first locator piece 12 is approximately ⅔ the height of the front of the body and has a straight portion 15 (the portion 15 could also be bent or curved) which is attached to the front of the body by, for example, rivets (although other fasteners could be used). Above the portion 15 the first locator piece curves into an aperture formed in the front of the body and then has a reverse bend 23 which brings the first locator piece back out of the aperture and it ends spaced in front of the body. The front end of the first locator piece 12 has three protrusions 19 (shown in FIG. 1) which are designed to fit into apertures 21 and 21' formed in the tickets 20, shown in FIG. 3. It should be noted if the tickets used with the ticket dispenser 1 do not have these apertures the protrusions could be eliminated from the front of the first locator piece 12. The protrusions 19 "locate" the tickets in proper position so a downward pull on the ticket will force the perforations 22, in the ticket, against the front of the locator and help to separate the tickets.

A second locator piece 13 is mounted approximately 3/32 of an inch above the radius of the first locator piece as it exits from the aperture in the front of the body. The purpose of the second locator piece 13 is to slightly "pinch" the tickets against the first locator piece. This makes the ticket follow the curve in the first locator piece and makes the end of the ticket rise above the first locator piece so it is easier to grasp.

Also shown in FIG. 2 is a flexible strap 18 for carrying the ticket dispenser, and which is attached to the sides of the plexiglass body by snaps 8. The snaps make the strap easily removable if it is not needed. Of course the strap could be permanently attached to the body, if desired, by rivets or screws, for example. Also shown in FIG. 2 is a handle 17 attached to the back of the holder by a hinge 24, and to the front of the holder by a conventional snap (not shown). The handle could also be used to carry the ticket dispenser in addition to or in lieu of the strap 18. The handle serves the additional function of partially protecting the tickets. It should be noted that the strap 18 and the handle 17 were removed from FIG. 1 for purposes of clarity.

FIG. 2 also shows the containers 14 which fit into the semi-circular portions 3 and 4. The containers can be used to hold any of the items associated with selling tickets such as, but not limited to, change, extra tickets, pens, pencils, paper clips, etc. Also, the containers can be fitted with lids 6 and handles 7 if desired. Also, the handles 7 could be eliminated and a slot could be placed in the lid which would serve the same purpose as the handle 7.

In order to use the ticket dispenser 1, the strap 18 will be pulled down so the handle 17 can be moved. The handle will then be unsnapped from the front of the body and pivoted back by means of the hinge 24. The shaft 9 will be removed by spreading the sides 2 and 11 apart slightly and pulling up on the shaft. The shaft will be inserted into the roll of tickets 16, and the shaft and the tickets will be replaced into the body. The first ticket will be threaded between the first locator piece 12 and the second locator piece 13. The handle 17 will then be rotated back and snapped into place, and the ticket dispenser will be ready to use.

Although the ticket dispenser and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A ticket dispenser comprising:

body means for holding a continuous roll of flexible tickets, an outfeed aperture in said body means, vertically spaced locator means for locating at least one ticket on said roll of flexible tickets in position to be grasped, separating means for separating at least two adjacent tickets on said roll of flexible tickets at a parting line which extends across said at least two adjacent tickets, and container means attached to said body means for holding items associated with sale of said tickets.

2. The ticket dispenser as claimed in claim 1, wherein a handle means is attached to said body means for moving said ticket dispenser.

3. The ticket dispenser as claimed in claim 2, wherein said handle means is attached to said body means at one end by a hinge.

4. The ticket dispenser as claimed in claim 1, wherein a strap means is attached to said body means for moving said ticket dispenser.

5. The ticket dispenser as claimed in claim 1, wherein a strap means and a handle means are attached to said body means for moving said ticket dispenser.

6. The ticket dispenser as claimed in claim 1, wherein at least a portion of said body means is shaped to secure said container means in a friction fit.

7. The ticket dispenser as claimed in claim 1, wherein said container means are fitted with a lid.

8. The ticket dispenser as claimed in claim 1, wherein said vertically spaced locator means is made in two pieces, a first one of said two pieces having a portion attached to said body means, a second one of said two pieces is spaced vertically from said first one of said two pieces and has a reverse bend, and has a first portion connected to said body means, and a second portion connected to said reverse bend, said second portion having a free end, said free end having a plurality of protrusions thereon, which cooperate with apertures in said roll of flexible tickets to help position said tickets, whereby said first one of said two pieces holds said tickets against said second one of said two pieces.

9. A ticket dispenser which is adapted to dispense a roll of tickets which has a single row of tickets or which can dispense a roll of tickets which has a double row of side-by-side tickets, each of said tickets in a first row of said double row of side-by-side tickets being connected to a preceding and a following ticket, and connected to a ticket in a second row, said ticket dispenser comprising:

body means for holding a continuous roll of flexible tickets, shaft means connected to said body means for holding said continuous roll of flexible tickets, said shaft means being at least as wide as two tickets placed side-by-side, spacer means detachably connected only to said shaft means and surrounding said shaft means, said spacer means being approximately as wide as a single ticket, an outfeed aperture in said body means, vertically spaced locator means, attached to said body means adjacent said outfeed aperture, for locating at least one ticket on said roll of flexible tickets in position to be grasped, separating means on said vertically spaced locator means for separating said at least one ticket on said roll of flexible tickets from an adjacent ticket at a parting line which extends across said at least one ticket, and container means attached to said body means for holding items associated with sale of said tickets, whereby if a single row of tickets is to be dispensed, said spacer means is positioned on said shaft means to properly position said single row of tickets in said outfeed aperture, and if a double row of tickets is to be dispensed, said spacer means is removed from said shaft means to properly position said double row of tickets in said outfeed aperture.

10. A ticket dispenser comprising:

body means for holding a continuous roll of flexible tickets, an outfeed aperture in said body means, vertically spaced locator means for locating at least one ticket on said roll of flexible tickets in position to be grasped, said vertically spaced locator means comprising an upper member attached to an outside portion of said body means above said outfeed aperture, said upper member extending downwardly toward said outfeed aperture, said vertically spaced locator means comprising a lower member having a first portion attached to an outside portion of said body means below said outfeed aperture, said lower member having a second portion, attached to said first portion, which extends into said outfeed aperture, said lower member having a third portion attached to said second portion, said third portion having a reverse bend therein, at least a portion of said reverse bend being positioned directly beneath said upper member, said lower member having a fourth portion attached to said reverse bend, said fourth portion having a free end, separating means on said free end for separating at least two adjacent tickets on said roll of flexible tickets at a parting line which extends across said at least two adjacent tickets, and container means attached to said body means for holding items associated with sale of said tickets.

* * * * *